US009802406B2

(12) United States Patent
Nishikawa

(10) Patent No.: US 9,802,406 B2
(45) Date of Patent: Oct. 31, 2017

(54) LIQUID JET HEAD AND LIQUID JET DEVICE

(71) Applicant: SII Printek Inc., Chiba-shi, Chiba (JP)

(72) Inventor: Daichi Nishikawa, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 15/380,306

(22) Filed: Dec. 15, 2016

(65) Prior Publication Data

US 2017/0173956 A1 Jun. 22, 2017

(30) Foreign Application Priority Data

Dec. 16, 2015 (JP) ..... 2015-245471

(51) Int. Cl.
*B41J 2/14* (2006.01)

(52) U.S. Cl.
CPC ..... *B41J 2/14209* (2013.01); *B41J 2/14072* (2013.01); *B41J 2/14201* (2013.01); *B41J 2002/14491* (2013.01); *B41J 2202/18* (2013.01)

(58) Field of Classification Search
CPC ..... B41J 2/14209; B41J 2/14072; B41J 2/14201; B41J 2202/18; B41J 2002/14491
See application file for complete search history.

(56) References Cited

U.S. PATENT DOCUMENTS

2014/0118440 A1* 5/2014 Kubota ..... B41J 2/14209 347/40
2015/0029271 A1 1/2015 Domae et al.
2015/0145927 A1 5/2015 Murochi

FOREIGN PATENT DOCUMENTS

EP 1 923 219 A2 5/2008
JP 2015-024629 A 2/2015
JP 2015-100947 A 6/2015

OTHER PUBLICATIONS

Partial Search Report in corresponding European Application No. 16204496.0, dated Apr. 20, 2017, 12 pages.

* cited by examiner

*Primary Examiner* — Geoffrey Mruk
(74) *Attorney, Agent, or Firm* — Brinks Gilson & Lione

(57) ABSTRACT

The present invention relates to a liquid jet device comprising an actuator plate on which injection channels and non-injection channels are arranged side by side, a cover plate laminated on a surface of the actuator plate and including slits communicating into the injection channels, common electrodes and individual electrodes formed on inner surfaces of the injection channels and the non-injection channels, and common wires and individual wires formed on surfaces of bank portions of the actuator plate, and common pad portions and individual pad portions connected to the common wires and the individual wires, and connected to flexible boards in protruding end portions are formed in a portion of a back surface of the cover plate outside the slits.

9 Claims, 8 Drawing Sheets

LIQUID JET HEAD AND LIQUID JET DEVICE

RELATED APPLICATIONS

This application claims priority under 35 U.S.C. §119 to Japanese Patent Application No. 2015-245471 filed on Dec. 16, 2015, the entire content of which is hereby incorporated by reference.

BACKGROUND OF THE INVENTION

1. Field of the Invention

The present invention relates to a liquid jet head and a liquid jet device.

2. Description of the Related Art

As a device that injects droplet inks on a recording medium (for example, a sheet of paper) to record images and letters on the recording medium, there is an ink jet printer including an ink jet head. The ink jet head includes an actuator plate on which injection channels and non-injection channels are alternately arranged side by side, and a cover plate laminated on a surface of the actuator plate. A drive electrode for driving the actuator plate is formed on an inner surface of each of the channels. Further, a slit communicating into the injection channels is formed in the cover plate.

For example, JP 2015-24629 A discloses so-called a side shoot-type ink jet head. In the side shoot-type ink jet head, a nozzle plate including nozzle holes is joined to a back surface of the actuator plate. Then, in the side shoot-type ink jet head, the injection channels and the nozzle holes individually communicate into each other in a central portion in a channel extending direction.

In JP 2015-24629 A, a drive wire that connects the drive electrode and a flexible board is formed on the back surface of the actuator plate (on a joint surface of the nozzle plate). The drive wires are respectively connected to the corresponding drive electrodes of the channels through opening portions of the channels, in the back surface of the actuator plate. Meanwhile, the drive wires are connected to the flexible board in portions positioned outside the nozzle plate, in the back surface of the actuator plate.

SUMMARY OF THE INVENTION

By the way, in the above-described conventional technology, the flexible board is bonded to the actuator plate by thermocompression through an anisotropic conducting adhesive, for example. At that time, the anisotropic conducting adhesive may enter the channels through the opening portions of the channels (especially, the non-injection channels), in the back surface of the actuator plate. In this case, a stress acts on the actuator plate as the anisotropic conducting adhesive is thermally contracted in the channels. As a result, cracks and the like occur in the actuator plate, which becomes a cause of a decrease in the yield.

Further, when the flexible board is bonded to the back surface of the actuator plate, a level difference is caused between the back surface of the actuator plate and a back surface of the flexible board. The flexible board has larger thickness tolerance than the nozzle plate and the like. Therefore, variation easily occurs in the height of the level difference formed between the actuator plate and the flexible board. As a result, it is difficult to assemble the ink jet head to keep the distance between the recording medium and the nozzle plate constant.

Meanwhile, J P 2015-100947 discloses a configuration to form a drive wire on a back surface of a cover plate. In JP 2015-100947 A, the drive wire is pulled out to a portion of the cover plate, the portion being positioned outside an actuator plate, and is connected to a flexible board.

However, in the configuration of JP 2015-100947 A, the drive wire is connected to a drive electrode in a portion of the cover plate, the portion being closer to a channel with respect to a slit. Therefore, in pulling out the drive wire to the portion positioned outside the slit in the cover plate, the drive wire needs to be pulled out avoiding the slit. In this case, wire formation may become difficult due to a narrow pitch between the drive wires, and the like.

The present invention has been made in view of the foregoing, and an objective is to provide a liquid jet head and a liquid jet device that can improve the yield and assemblability, after achieving facilitation of wire formation.

In order to solve the problem, a liquid jet head according to an aspect of the present invention comprises: an actuator plate on which jet channels and non-jet channels extending along a first direction are alternately arranged side by side at intervals in a second direction intersecting with the first direction; a cover plate laminated on a surface of the actuator plate, and including a liquid supply path communicating into the jet channel; a drive electrode formed on inner surfaces of the jet channel and the non-jet channel; and a drive wire formed on the surface of the actuator plate outside the liquid supply path in the first direction, and connected to the drive electrode, wherein the cover plate includes a protruding end portion protruding outward in the first direction with respect to the actuator plate, and a pad portion connected to the drive wire and connected to an external wire in the protruding end portion is formed on a portion of a back surface of the cover plate outside the liquid supply path in the first direction.

According to the present aspect, the drive wire is formed on the surface of the actuator plate positioned outside the liquid supply path in the first direction, so that it becomes unnecessary to pull out the drive wire, avoiding the liquid supply path, in pulling out the drive wire outside in the first direction with respect to the channel, like the conventional technology. Accordingly, occurrence of a restriction in a forming space of the wire on the surface of the actuator plate positioned outside the liquid supply path in the first direction can be suppressed. Therefore, the facilitation of wire formation, such as securing of the pitch between the drive wires, can be achieved.

Then, the external wire is connected on the back surface of the protruding end portion, in the cover plate, so that the entry of the anisotropic conducting adhesive into the channels through the opening portions of the channels in the back surface of the actuator plate can be suppressed at the time of mounting, unlike a configuration to mount a flexible board on a back surface of an actuator plate. Accordingly, occurrence of cracks and the like in the actuator plate due to thermal contraction of the anisotropic conducting adhesive can be suppressed, and improvement of the yield can be achieved.

Further, the external wire does not protrude to the back side beyond the back surface of the actuator plate. Therefore, variation in the nozzle surface height of the liquid jet head can be suppressed. Therefore, the assemblability in assembling the liquid jet head to a carriage can be improved, and the distance between the recording medium and the liquid jet head can be kept constant.

In the above aspect, the drive electrode may include a common electrode formed on the inner surface of the jet channel, and an individual electrode formed on the inner surface of the non-jet channel, the drive wire may include a common wire connected to the common electrode, and an individual wire bridging the individual electrodes facing each other in the second direction across the jet channel, a connection wire that collectively connects a plurality of the common wires may be formed on the cover plate, and the pad portion may include a common pad portion connected to the common wire through the connection wire, and an individual pad portion connected to each of the corresponding individual wires.

In the above aspect, the pad portions are pulled out to a back surface of the protruding end portion in the cover plate, so that the common electrode and the individual electrode can be connected to the external wire on the same surface. Accordingly, connection work between the cover plate and the external wire can be easily performed.

In the above aspect, one of the common wire and the individual wire may be formed on one side in the first direction of the jet channel, on the surface of the actuator plate, and the other of the common wire and the individual wire may be formed on the other side in the first direction of the jet channel, on the surface of the actuator plate.

According to the present aspect, the common wire and the individual wire are individually formed in portions of the surface of the actuator plate, the portions being positioned on both sides in the first direction across the jet channel, and the portions being positioned outside the liquid supply path in the first direction. Therefore, an area of the forming area of the wires can be secured. As a result, electric resistance in the wires can be decreased, and heat generation in the wires can be suppressed. Further, a short circuit between the wires can be suppressed. Further, connection failure can be decreased as a connection area between the external wire and the pad portions is increased.

In the above aspect, an uneven portion may be formed in a forming area of the pad portion, of the back surface of the cover plate.

According to the present aspect, the pad portion is formed to cover the uneven portion on the back surface of the cover plate, so that the area of the pad portion can be secured, compared with a case where the forming area of the pad portion is formed on a flat surface. Accordingly, the electric resistance of the pad portion can be decreased, and the heat generation in the pad portion can be suppressed.

A liquid jet head according to an aspect of the present invention includes: an actuator plate on which jet channels and non-jet channels extending along a first direction are alternately arranged side by side at intervals in a second direction intersecting with the first direction; a cover plate laminated on a surface of the actuator plate, and including a liquid supply path communicating into the jet channel; a common electrode formed on an inner surface of the jet channel; an individual electrode formed on an inner surface of the non-jet channel; a common wire formed on the surface of the actuator plate outside the liquid supply path in the first direction, and connected to the common electrode; and an individual wire formed on the surface of the actuator plate outside the liquid supply path in the first direction, and bridging the individual electrodes facing each other in the second direction across the jet channel, wherein an individual pad portion connected to the individual wire and connected to an external wire is formed on a portion of the cover plate outside the liquid supply path in the first direction.

According to the present aspect, the common wire and the individual wire are formed on the surface of the actuator plate positioned outside the liquid supply path in the first direction, so that it becomes unnecessary to pull out the drive wire, avoiding the liquid supply path, in pulling out the common wire and individual wire outside in the first direction with respect to the channel, like the conventional technology. Accordingly, occurrence of a restriction in a forming space of the wire on the surface of the actuator plate positioned outside the liquid supply path in the first direction can be suppressed. Therefore, the facilitation of wire formation, such as securing of the pitch between the drive wires, can be achieved. In this case, especially, an electrode that requires individual application of a voltage and individual connection to the external wire, like the individual electrode, is connected to the individual wire outside the liquid supply path in the first direction, so that the facilitation of the wire formation becomes more remarkable.

A liquid jet device according to an aspect of the present invention includes: the liquid jet head according to the above aspect; and a moving mechanism configured to relatively move the liquid jet head and a recording medium.

According to the present aspect, the liquid jet head of the above aspect is included, and therefore a reliable liquid jet device can be provided.

According to one aspect of the present invention, the yield and assemblability can be improved after facilitation of the wire formation is achieved.

DETAILED DESCRIPTION OF THE PREFERRED EMBODIMENTS

Figure 1:
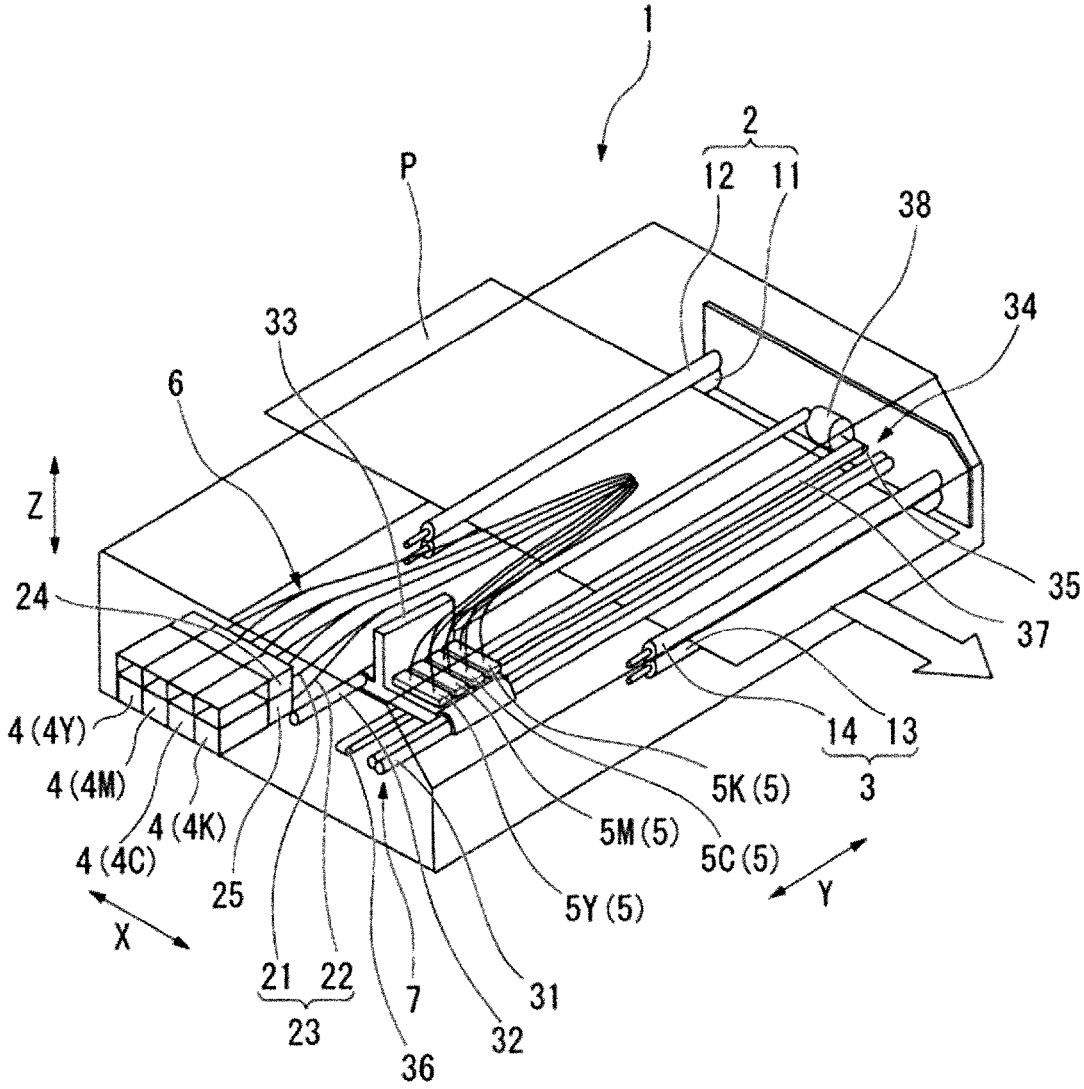
FIG. 1 is a schematic configuration view of an ink jet printer according to an embodiment.

Hereinafter, an embodiment according to the present invention will be described with reference to the drawings. In the embodiment below, as an example of a liquid jet device including a liquid jet head of the present invention, an ink jet printer (hereinafter, simply referred to as printer) that performs recording on a recording medium, using an ink (liquid) will be exemplarily described. Note that, in the drawings used in the description below, scales of members are appropriately changed to make the members recognizable.

[Printer]

FIG. 1 is a schematic configuration view of a printer 1.

As illustrated in FIG. 1, the printer 1 of the present embodiment includes a pair of conveyance means 2 and 3, an ink tank 4, an ink jet head 5 (liquid jet head) 5, ink circulation means 6, and scanning means (moving mechanism) 7. Note that the description below will be given using an X, Y, Z rectangular coordinate system, as needed. In this case, an X direction accords with a conveying direction of a recording medium P (for example, a sheet of paper). A Y direction accords with a scanning direction of the scanning means 7. A Z direction represents a height direction perpendicular to the X direction and the Y direction.

The conveyance means 2 and 3 convey the recording medium P in the X direction. To be specific, the conveyance means 2 includes a grid roller 11 extending in the Y direction, a pinch roller 12 extending in parallel to the grid roller 11, and a drive mechanism (not illustrated) such as a motor that axially rotates the grid roller 11. Similarly, conveyance means 3 includes a grid roller 13 extending in the Y direction, a pinch roller 14 extending in parallel to the grid roller 13, and a drive mechanism (not illustrated) that axially rotates the grid roller 13.

The ink tank 4 includes ink tanks 4Y, 4M, 4C, and 4K that respectively accommodate inks of four colors including yellow, magenta, cyan, and black. In the present embodiment, the ink tanks 4Y, 4M, 4C, and 4K are provided side by side in the X direction.

Figure 2:
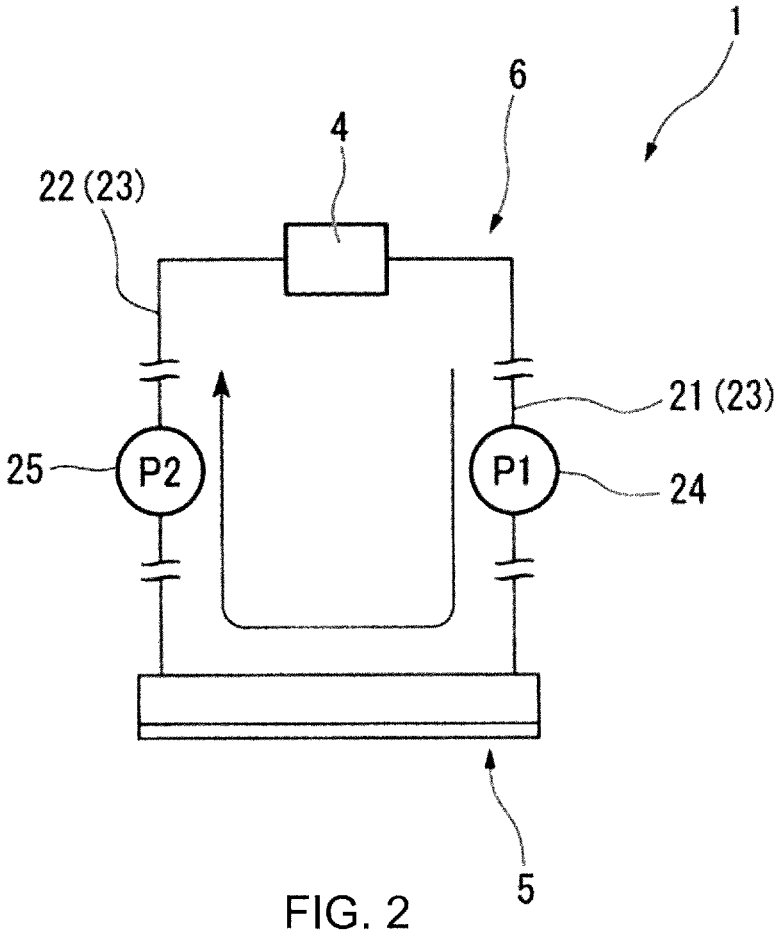
FIG. 2 is a schematic configuration view of an ink jet head and ink circulation means according to an embodiment.

FIG. 2 is a schematic configuration view of the ink jet head 5 and the ink circulation means 6.

As illustrated in FIGS. 1 and 2, the ink circulation means 6 circulates the ink between the ink tank 4 and the ink jet head 5. To be specific, the ink circulation means 6 includes a circulation flow channel 23 including an ink supply pipe 21 and an ink discharge pipe 22, a pressure pump 24 connected to the ink supply pipe 21, and a suction pump 25 connected to the ink discharge pipe 22. Note that the ink supply pipe 21 and the ink discharge pipe 22 are configured from a flexible hose that can follow movement of the scanning means 7 that supports the ink jet head 5.

The pressure pump 24 pressurizes an inside of the ink supply pipe 21, and sends the ink to the ink jet head 5 through the ink supply pipe 21. Accordingly, the ink supply pipe 21 side provides a positive pressure with respect to the ink jet head 5.

The suction pump 25 depressurizes an inside the ink discharge pipe 22, and sucks the ink from the ink jet head 5 through the ink discharge pipe 22. Accordingly, the ink discharge pipe 22 side provides a negative pressure with respect to the ink jet head 5. Then, the ink can be circulated between the ink jet head 5 and the ink tank 4 through the circulation flow channel 23 by drive of the pressure pump 24 and the suction pump 25.

As illustrated in FIG. 1, the scanning means 7 causes the ink jet head 5 to perform scanning in the Y direction in a reciprocative manner. To be specific, the scanning means 7 includes a pair of guide rails 31 and 32 extending in the Y direction, a carriage 33 movably supported by the pair of guide rails 31 and 32, and a drive mechanism 34 that moves the carriage 33 in the Y direction. Note that the conveyance means 2 and 3 and the scanning means 7 configure a moving mechanism that relatively moves the ink jet head 5 and the recording medium P.

The drive mechanism 34 is arranged between the guide rails 31 and 32 in the X direction. The drive mechanism 34 includes a pair of pulleys 35 and 36 arranged at an interval in the Y direction, an endless belt 37 wound between the pair of pulleys 35 and 36, and a drive motor 38 that rotates and drives one pulley 35.

The carriage 33 is connected to the endless belt 37. A plurality of ink jet heads 5Y, 5M, 5C, and 5K that injects the inks of four colors including yellow, magenta, cyan, and black is mounted on the carriage 33. In the present embodiment, the ink jet heads 5Y, 5M, 5C, and 5K are arranged side by side in the Y direction.

<Ink Jet Head>

Figure 3:
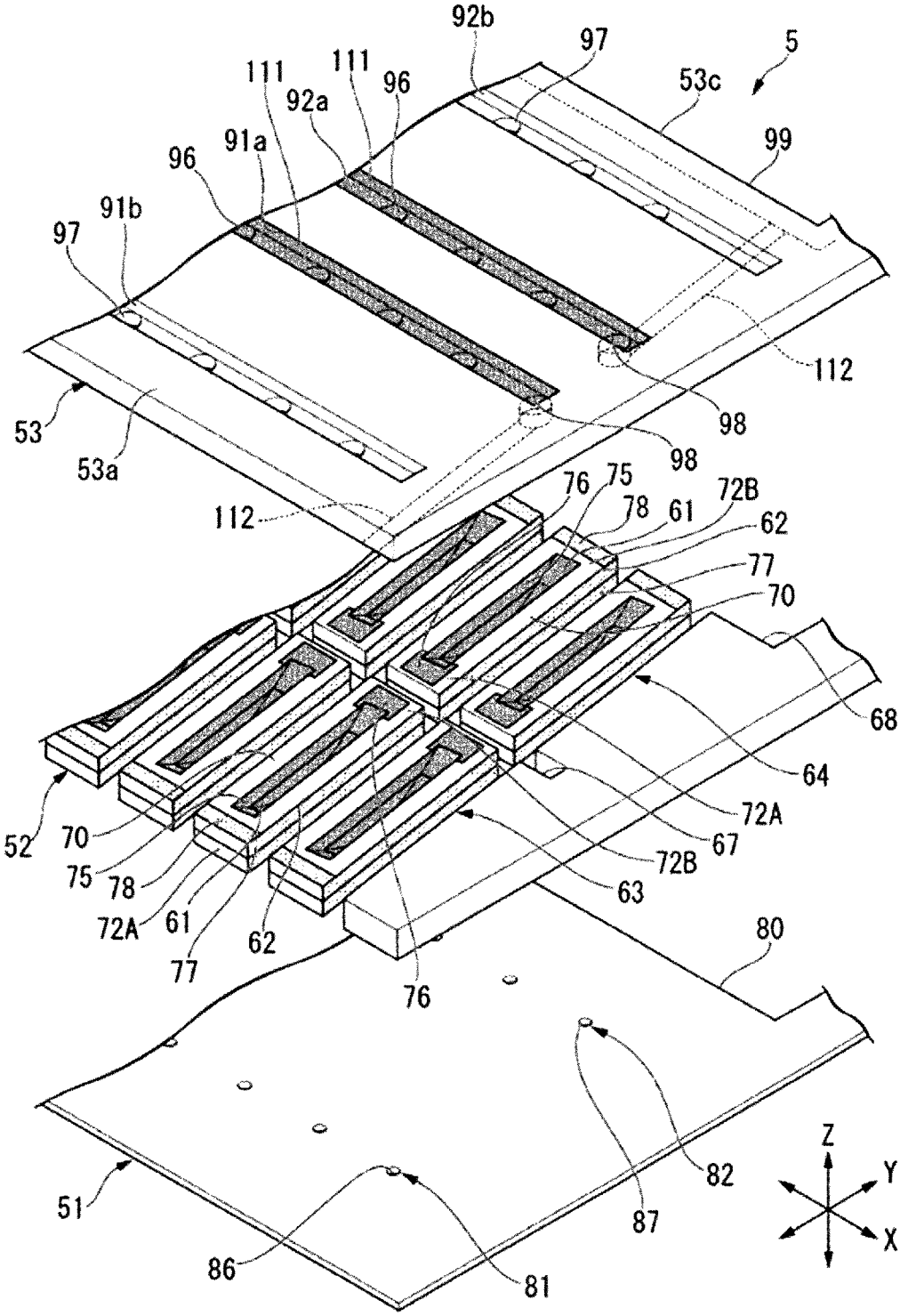
FIG. 3 is an exploded perspective view of an ink jet head according to an embodiment.

FIG. 3 is an exploded perspective view of the ink jet head 5. Note that the ink jet heads 5Y, 5M, 5C, and 5K are made of the same configuration except for the colors of the inks to be supplied, and thus are collectively described as the ink jet head 5 in the description below.

The ink jet head 5 illustrated in FIG. 3 is a circulation side shoot-type ink jet head that injects the ink from a central portion in a channel extending direction (first direction) in an injection channel 61 described below, and circulates the ink between the ink jet head 5 and the ink tank 4.

The ink jet head 5 mainly includes a nozzle plate 51, an actuator plate 52, and a cover plate 53. Then, the ink jet head 5 has a configuration in which the nozzle plate 51, the actuator plate 52, and the cover plate 53 are laminated in the Z direction in this order with an adhesive or the like. Note that description below will be given, where the cover plate 53 side with respect to the actuator plate 52 is a front side, and the nozzle plate 51 side with respect to the actuator plate 52 is a back side, of the above-described Z direction.

<Actuator Plate>

The actuator plate 52 is formed of piezoelectric material such as lead zirconate titanate (PZT). The actuator plate 52 is so-called a chevron board made of two laminated piezoelectric plates having different polarization directions in the Z direction.

Figure 4:
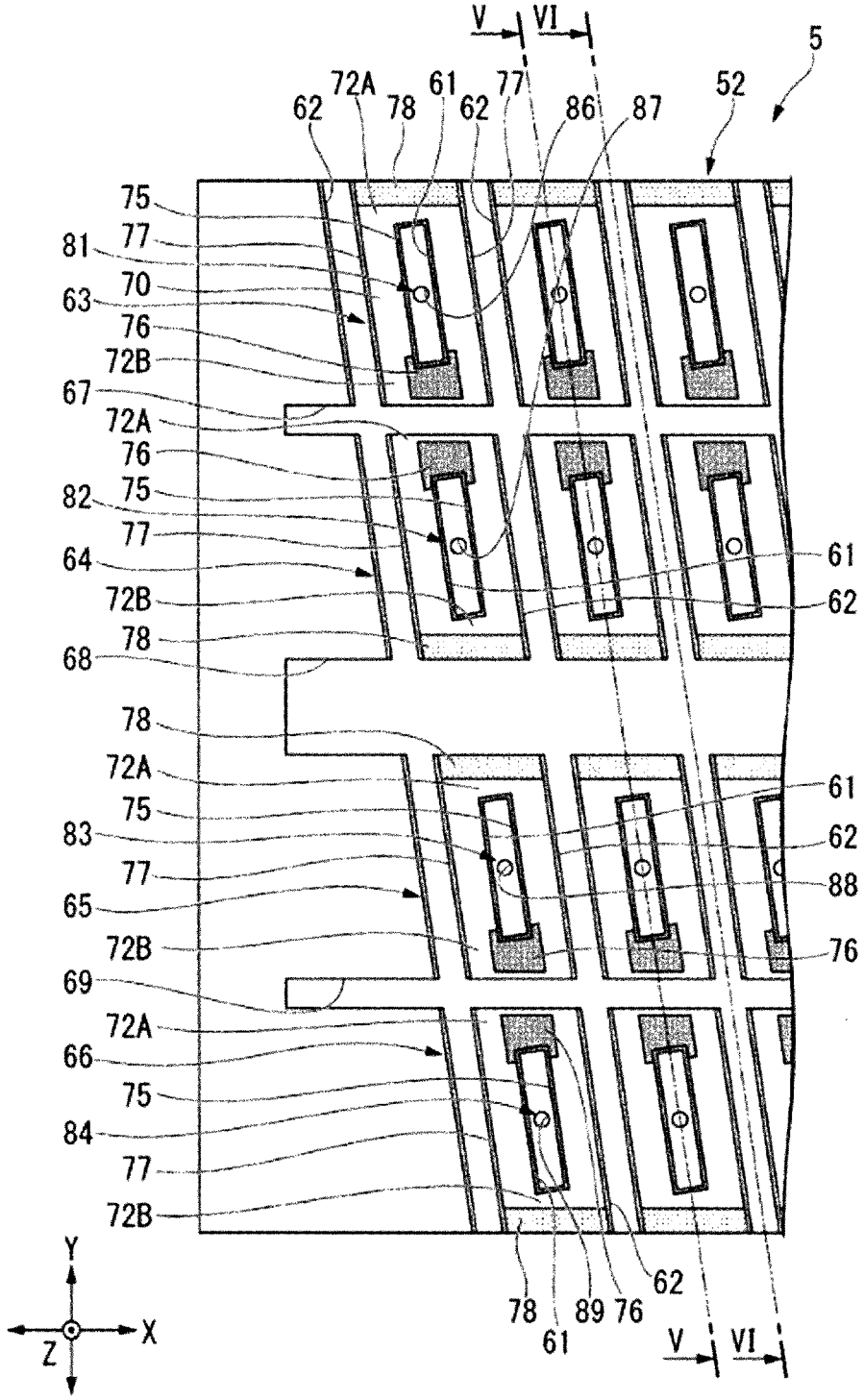
FIG. 4 is a plan view of an actuator plate according to an embodiment.

FIG. 4 is a plan view of the actuator plate 52.

As illustrated in FIGS. 3 and 4, four channel arrays 63 to 66 extending in the X direction are arrayed at intervals in the Y direction on the actuator plate 52. In the present embodiment, the channel arrays 63 to 66 are a first channel array 63, a second channel array 64, a third channel array 65, and a fourth channel array 66. Note that, in the description below, the first channel array 63 side may be referred to as one side, and the fourth channel array 66 side may be referred to as the other side, of the Y direction or the channel extending direction.

Dividing portions 67 to 69 that divide the channel arrays 63 to 66 adjacent in the Y direction are formed in portions positioned between each two of the channel arrays 63 to 66, in the actuator plate 52. The dividing portions 67 to 69 are a first dividing portion 67 positioned between the first channel array 63 and the second channel array 64, a second dividing portion 68 positioned between the second channel array 64 and the third channel array 65, and a third dividing portion 69 positioned between the third channel array 65 and the fourth channel array 66. The dividing portions 67 to 69 penetrate the actuator plate 52 in the Z direction. In the present embodiment, the width in the Y direction of the second dividing portion 68 is broader than those of the first dividing portion 67 and the third dividing portion 69.

As illustrated in FIG. 4, the dividing portions 67 to 69 extend in the X direction. Both end portions in the X direction in the dividing portions 67 to 69 are positioned outside the channel arrays 63 to 66 in the X direction. In the example of FIG. 3, the dividing portions 67 to 69 are formed in the entire area except both end portions in the X direction in the actuator plate 52. Note that the dividing portions 67 to 69 may penetrate the actuator plate 52 in the X direction.

The first channel array 63 includes an injection channel (jet channel) 61 filled with the ink and a non-injection channel (non-jet channel) 62 not filled with the ink. The channels 61 and 62 are alternately arranged at an interval in the X direction (second direction). A portion of the actuator plate 52, the portion being positioned between the injection channel 61 and the non-injection channel 62, configures a drive wall 70 that partitions the injection channel 61 and the non-injection channel 62 in the X direction. Note that, in the description below, a configuration regarding the first channel array 63 will be mainly described, and portions in configurations regarding the other channel arrays 64 to 66, the portions corresponding to the first channel array 63, are denoted with the same reference signs, and description is omitted.

The injection channel 61 generally extends along the Y direction in plan view as viewed from the Z direction. However, in particular, the injection channel 61 of the present embodiment extends in a direction (channel extending direction) intersecting with the Y direction in plan view. Note that the channel extending direction may accord with the Y direction.

Figure 5:
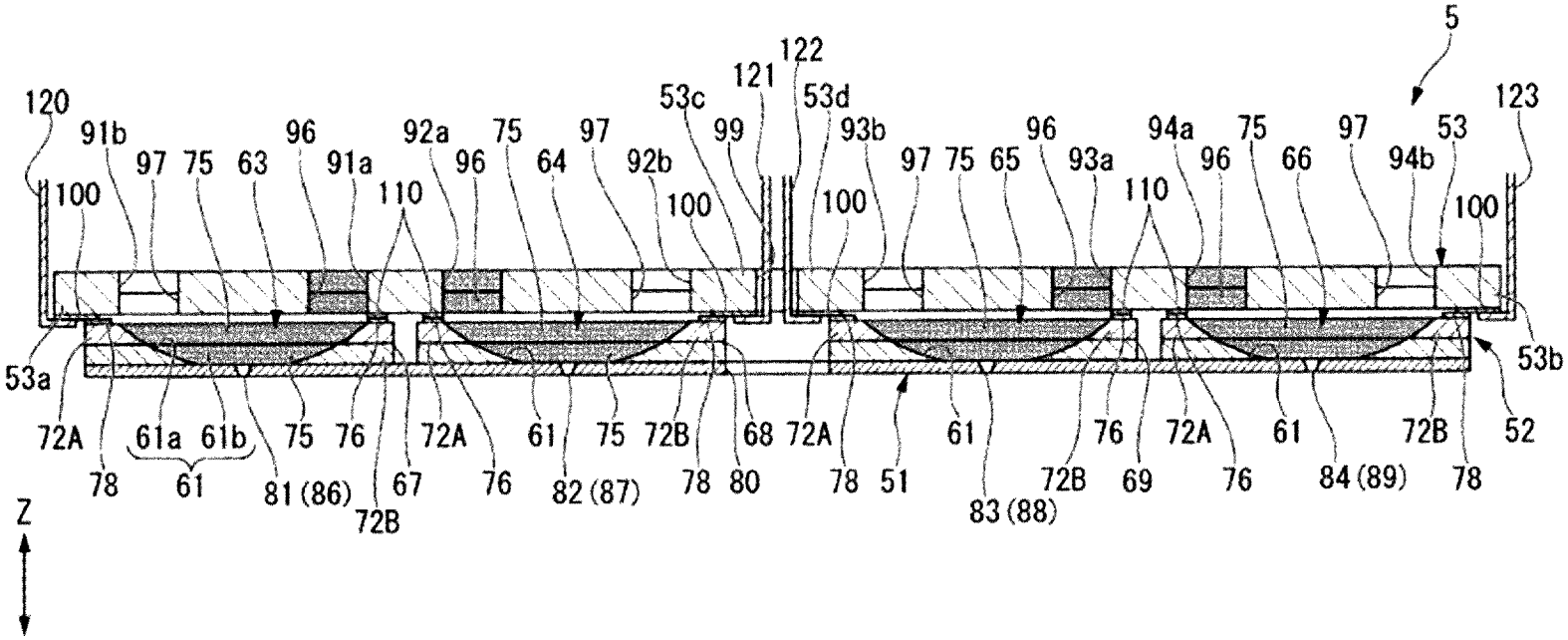
FIG. 5 is a sectional view corresponding to a V-V line of FIG. 4.

FIG. 5 is a sectional view corresponding to the V-V line of FIG. 4.

As illustrated in FIG. 5, the injection channel 61 is formed in a curved recess shape toward a back side in side view as viewed from the X direction. To be specific, the injection channel 61 includes rising portions 61*a* positioned in both end portions in the channel extending direction, and an intermediate portion 61*b* positioned between the rising portions 61*a*.

The rising portion 61*a* extends while being curved toward a front side as going both sides in the channel extending direction.

The intermediate portion 61*b* penetrates the actuator plate 52 in the Z direction.

As illustrated in FIG. 4, the non-injection channels 62 extend in parallel to the injection channel 61, on both sides in the X direction with respect to each of the injection channels 61, of the actuator plate 52.

Figure 6:
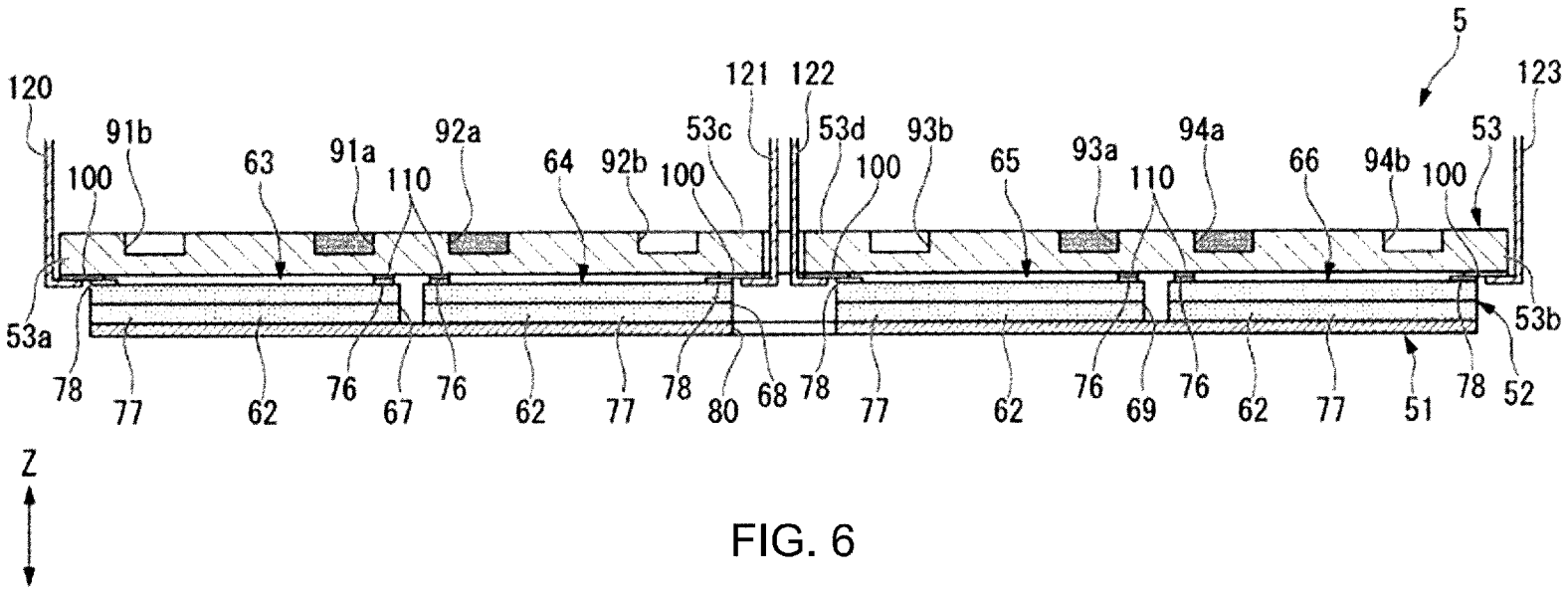
FIG. 6 is a sectional view corresponding to a VI-VI line of FIG. 4.

FIG. 6 is a sectional view corresponding to the VI-VI line of FIG. 3.

As illustrated in FIG. 6, the groove depth in the Z direction of the non-injection channel 62 is uniformly formed throughout. In the present embodiment, the non-injection channel 62 penetrates the actuator plate 52 in the Z direction. One end portion in the channel extending direction in the non-injection channel 62 is open on one end surface in the Y direction in the actuator plate 52. The other end portion in the channel extending direction in the non-injection channel 62 is open in a first dividing portion 67.

In the present embodiment, the length in the channel extending direction in the non-injection channel 62 is longer than that of the injection channel 61. Therefore, the non-injection channel 62 overlaps with the entire injection channel 61 in side view as viewed from the X direction, and both end portions in the channel extending direction of the non-injection channel 62 protrude outside the injection channel 61 in the channel extending direction. Note that the length of the non-injection channel 62 is a distance from a boundary portion between the first dividing portion 67 and the non-injection channel 62 to the one end surface in the Y direction in the actuator plate 52, in the channel extending direction.

As illustrated in FIGS. 4 and 5, a common electrode (drive electrode) 75 is formed on an inner surface of the injection channel 61. The common electrode 75 is continuously formed throughout the entire periphery (inside surfaces facing each other in the X direction and a bottom surface of the rising portion 61*a*) of the inner surface of the injection channel 61. Further, the common electrode 75 is formed throughout the entire inner surface of the injection channel 61 in the Z direction.

Portions of the actuator plate 52 on both sides in the Y direction of the injection channel 61 and positioned between the non-injection channels 62 adjacent in the X direction configure one bank portion 72A and the other bank portion 72B. The one bank portion 72A is positioned on one side in the Y direction of the injection channel 61. The other bank portion 72B is positioned on the other side in the Y direction of the injection channel 61, and positioned between the injection channel 61 and the first dividing portion 67.

A common wire (drive wire) 76 is formed on a surface of the other bank portion 72B. The common wire 76 is formed into a strip shape extending in the channel extending direction. One end portion in the channel extending direction in the common wire 76 is connected to the common electrode 75 at the other opening edge in the channel extending direction in the injection channel 61. In the illustrated example, the one end portion in the channel extending direction in the common wire 76 encloses the other end portion in the Y direction of the injection channel 61 from both sides in the X direction on the surface of the actuator plate 52.

The other end portion in the channel extending direction in the common wire 76 is terminated in the other bank portion 72B.

As illustrated in FIGS. 4 and 6, individual electrodes (drive electrodes) 77 are formed on the inner surfaces of the non-injection channels 62. The individual electrodes 77 are individually formed on inside surfaces facing each other in the X direction, of the inner surface of the non-injection channel 62. Therefore, the facing individual electrodes 77 in the same non-injection channel 62, of the individual electrodes 77, are electrically separated from each other. Further, the individual electrode 77 is formed throughout the entire inside surface of the non-injection channel 62 in the Z direction and the channel extending direction.

As illustrated in FIGS. 3 and 4, an individual wire (drive wire) 78 is formed on a surface of the one bank portion 72A, in the actuator plate 52. The individual wire 78 extends in the X direction on the surface of the one bank portion 72A. The individual wire 78 connects the individual electrodes 77 facing in the X direction across the injection channel 61. As described above, in the present embodiment, the common wire 76 and the individual wire 78 are arranged in mutually separate portions across the injection channel 61, on the surface of the actuator plate 52. That is, the common wire 76 and the individual wire 78 are separately formed in the different bank portions 72A and 72B. Note that the common wire 76 may be drawn on the one bank portion 72A, and the individual wire 78 may be drawn on the other bank portion 72B. Further, the common wire 76 and the individual wire 78 may be drawn on the same bank portion 72A or 72B.

As illustrated in FIG. 4, the second channel array 64, the third channel array 65, and the fourth channel array 66 are configured such that the injection channels 61 and the non-injection channels 62 are alternately arranged in the X direction, similarly to the first channel array 63. The injection channels 61 and the non-injection channels 62 of the channel arrays 64 to 66 are formed at equal array pitches to the injection channels 61 and the non-injection channels 62 of the first channel array 63. In this case, in the channel arrays 63 to 66, the channel extending directions of the injection channels 61 facing in the channel extending direction are arranged on the same straight line. Further, in the channel arrays 63 to 66, the channel extending directions of the non-injection channels 62 facing in the channel extending direction are arranged on the same straight line. Note that, in the channel arrays 63 to 66 adjacent in the Y direction, the injection channels 61 and the non-injection channels 62 may be arranged in an alternate (staggered)

fashion in the X direction. Further, the injection channels 61 and the non-injection channels 62 are not necessarily arranged on the same straight line among the channel arrays 63 to 66. Further, for example, between the first channel array 63 and the second channel array 64, the injection channels 61 and the non-injection channels 62 facing in the channel extending direction may be arranged on the same straight line. Further, between the third channel array 65 and the fourth channel array 66, the injection channels 61 and the non-injection channels 62 facing in the channel extending direction may be arranged on the same straight line.

In the actuator plate 52, the common wire 76 is formed on the surface of the one bank portion 72A corresponding to the second channel array 64. Meanwhile, in the actuator plate 52, the individual wire 78 is formed on the surface of the other bank portion 72B corresponding to the second channel array 64. That is, the corresponding common wires 76 of the first channel array 63 and the second channel array 64 are arranged in portions positioned between the first channel array 63 and the second channel array 64, on the surface of the actuator plate 52. Meanwhile, the corresponding individual wires 78 of the first channel array 63 and the second channel array 64 are arranged in mutually separate portions across the first channel array 63 and the second channel array 64, on the surface of the actuator plate 52.

Further, the first channel array 63 and the second channel array 64, and the third channel array 65 and the fourth channel array 66 are formed in a point symmetrical manner, having the center of the actuator plate 52 as a center of symmetry in plan view as viewed in the Z direction.

Therefore, in the actuator plate 52, the individual wire 78 is formed on the surface of the one bank portion 72A corresponding to the third channel array 65. In the actuator plate 52, the common wire 76 is formed on the surface of the other bank portion 72B corresponding to the third channel array 65.

In the actuator plate 52, the common wire 76 is formed on the surface of the one bank portion 72A corresponding to the fourth channel array 66. In the actuator plate 52, the individual wire 78 is formed on the surface of the other bank portion 72B corresponding to the fourth channel array 66.

<Nozzle Plate>

As illustrated in FIGS. 5 and 6, the nozzle plate 51 adheres to a back surface of the actuator plate 52. In the present embodiment, the nozzle plate 51 blocks the intermediate portions 61*b* of the injection channels 61 and the non-injection channels 62 from the back side.

Four nozzle arrays (a first nozzle array 81, a second nozzle array 82, a third nozzle array 83, and a fourth nozzle array 84) extending in parallel to each other in the X direction are arranged in the nozzle plate 51 at intervals in the Y direction. Further, a through hole 80 that penetrates the nozzle plate 51 in the Z direction is formed in a portion of the nozzle plate 51, the portion overlapping with the second dividing portion 68 of the actuator plate 52 in plan view.

The nozzle arrays 81 to 84 respectively include nozzle holes 86 to 89 that penetrate the nozzle plate 51 in the Z direction. The nozzle holes 86 to 89 are respectively arranged side by side on straight lines at intervals in the X direction, in the same nozzle arrays 81 to 84. The nozzle holes 86 to 89 communicate into the injection channels 61 of the corresponding channel arrays 63 to 66. To be specific, the nozzle holes 86 to 89 are formed to be positioned in central portions in the channel extending direction in the injection channels 61 of the corresponding channel arrays 63 to 66. Therefore, the non-injection channels 62 of the channel arrays 63 to 66 do not communicate into the nozzle holes 86 to 89, and are covered with the nozzle plate 51 from the back side. Note that the nozzle holes 86 to 89 are formed in a tapered manner, the diameters of which are gradually reduced toward the back side.

As illustrated in FIGS. 3 and 4, the nozzle arrays 81 to 84 respectively have the nozzle holes 86 to 89 arrayed at equal pitches in the X direction. Further, among the nozzle arrays 81 to 84, the nozzle holes 86 to 89 offset each other in the X direction. In this case, the nozzle holes 86 to 89 favorably offset each other at every ¼ pitches of the array pitch of the nozzle holes 86 to 89, for example. Note that design of offset amounts of the nozzle holes 86 to 89 can be appropriately changed.

<Cover Plate>

As illustrated in FIGS. 5 and 6, the cover plate 53 adheres to the surface of the actuator plate 52 to block the channels 61 and 62. The width in the Y direction of the cover plate 53 is formed longer than that of the actuator plate 52. Therefore, both end portions in the Y direction in the cover plate 53 protrude outside the actuator plate 52 in the Y direction. Then, a portion of the cover plate 53, the portion protruding toward one side in the Y direction with respect to the actuator plate 52, configures one protruding end portion 53*a*. A portion of the cover plate 53, the portion protruding toward the other side in the Y direction with respect to the actuator plate 52, configures the other protruding end portion 53*b*.

In the cover plate 53, inlet common ink chambers (a first inlet common ink chamber 91*a*, a second inlet common ink chamber 92*a*, a third inlet common ink chamber 93*a*, and a fourth inlet common ink chamber 94*a*) and outlet common ink chambers (a first outlet common ink chamber 91*b*, a second outlet common ink chamber 92*b*, a third outlet common ink chamber 93*b*, and a fourth outlet common ink chamber 94*b*) are formed. Note that, in the description below, the first inlet common ink chamber 91*a* and the first outlet common ink chamber 91*b* will be mainly described.

As illustrated in FIGS. 3 and 5, the first inlet common ink chamber 91*a* is formed in a portion of the cover plate 53, the portion facing, in the Z direction, the other end portion in the Y direction in the first channel array 63. The first inlet common ink chamber 91*a* is depressed toward the back side, and is formed into a recess groove shape extending in the X direction. Both end portions in the X direction in the first inlet common ink chamber 91*a* are positioned outside the first channel array 63 in the X direction. Supply slits (liquid supply paths) 96 that penetrate the cover plate 53 in the Z direction are respectively formed in positions of the first inlet common ink chamber 91*a*, the positions corresponding to the injection channels 61 (the positions are corresponding positions in the Z direction).

Note that, as illustrated in FIG. 5, in the back surface of the cover plate 53, the other opening edge in the channel extending direction of the supply slit 96 is formed in an equal position to the other end edge in the channel extending direction in the rising portion 61*a* (the other end edge is one end edge of the other bank portion 72B). Accordingly, the common wire 76 is arranged on the other side in the channel extending direction outside the supply slit 96 in plan view. Note that the other opening edge in the channel extending direction of the supply slit 96 may be arranged closer to the one side than the other end edge in the channel extending direction of the rising portion 61*a* is.

As illustrated in FIG. 3, wire slits 98 that penetrate the cover plate 53 in the Z direction are formed in portions of the first inlet common ink chamber 91*a*, the portions being outside the first channel array 63 in the X direction. The wire slits 98 expose portions of the surface of the actuator plate 52 to an outside, the portions being positioned outside the first channel array 63 in the X direction. Note that the inner diameter of the wire slit 98 may be formed larger than the inner diameter of the supply slit 96. Further, a plurality of the wire slits 98 may be formed in the portions positioned outside the first channel array 63 in the X direction.

As illustrated in FIGS. 3 and 5, the first outlet common ink chamber 91*b* is formed in a portion of the cover plate 53, the portion facing, in the Z direction, the one end portion in the Y direction in the first channel array 63. The first outlet common ink chamber 91*b* is depressed toward the back side, and is formed into a recess groove shape extending along the X direction. Both end portions in the X direction of the first outlet common ink chamber 91*b* are positioned outside the first channel array 63 in the X direction. Discharge slits (liquid supply paths) 97 that penetrate the cover plate 53 in the Z direction are respectively formed in positions of the first outlet common ink chamber 91*b*, the positions corresponding to the injection channels 61 (the positions are corresponding positions in the Z direction).

Therefore, the first inlet common ink chamber 91*a* and the first outlet common ink chamber 91*b* communicate into the injection channels 61 through the supply slits 96 and the discharge slits 97, respectively. Meanwhile, the first inlet common ink chamber 91*a* and the first outlet common ink chamber 91*b* do not communicate into the non-injection channels 62. That is, the non-injection channels 62 are blocked with bottom portions of the first inlet common ink chamber 91*a* and the first outlet common ink chamber 91*b*.

Note that, in the back surface of the cover plate 53, one opening edge in the channel extending direction of the discharge slit 97 is formed in an equal position to one end edge in the channel extending direction in the rising portion 61*a* (the one end edge is the other end edge of the one bank portion 72A). Therefore, the individual wire 78 is arranged on the one side in the channel extending direction outside the discharge slit 97 in plan view. Note that the one opening edge in the channel extending direction of the discharge slit 97 may be formed closer to the other side than the one end edge in the channel extending direction of the rising portion 61*a* is.

Further, as illustrated in FIG. 5, the inlet common ink chambers 92*a* to 94*a* and the outlet common ink chambers 92*b* to 94*b* corresponding to the other channel arrays 64 to 66 are also respectively formed in positions of the cover plate 53, the positions facing, in the Z direction, both end portions in the Y direction in the corresponding channel arrays 64 to 66. Then, the supply slits 96 that penetrate the cover plate 53 in the Z direction, are formed in positions corresponding to the injection channels 61, of the inlet common ink chambers 92*a* to 94*a* corresponding to the other channel arrays 64 to 66. Meanwhile, the discharge slits 97 that penetrate the cover plate 53 in the Z direction are formed in positions corresponding to the injection channels 61, of the outlet common ink chambers 92*b* to 94*b* corresponding to the other channel arrays 64 to 66.

An inserting hole 99 that penetrates the cover plate 53 in the Z direction is formed in a portion of the cover plate 53, the portion overlapping with the second dividing portion 68 of the actuator plate 52 in plan view. The width in the Y direction of the inserting hole 99 is narrower than that of the second dividing portion 68. In this case, a portion of the cover plate 53, the portion being exposed through the second dividing portion 68 in the actuator plate 52, and the portion being positioned on one side in the Y direction with respect to the inserting hole 99, configures one exposed end portion (protruding end portion) 53*c*. A portion of the cover plate 53, the portion being exposed through the second dividing portion 68 in the actuator plate 52, and the portion being positioned on the other side in the Y direction with respect to the inserting hole 99, configures the other exposed end portion (protruding end portion) 53*d*. Note that, in the present embodiment, the length in the X direction of the inserting hole 99 is equal to that of the second dividing portion 68.

Figure 7:
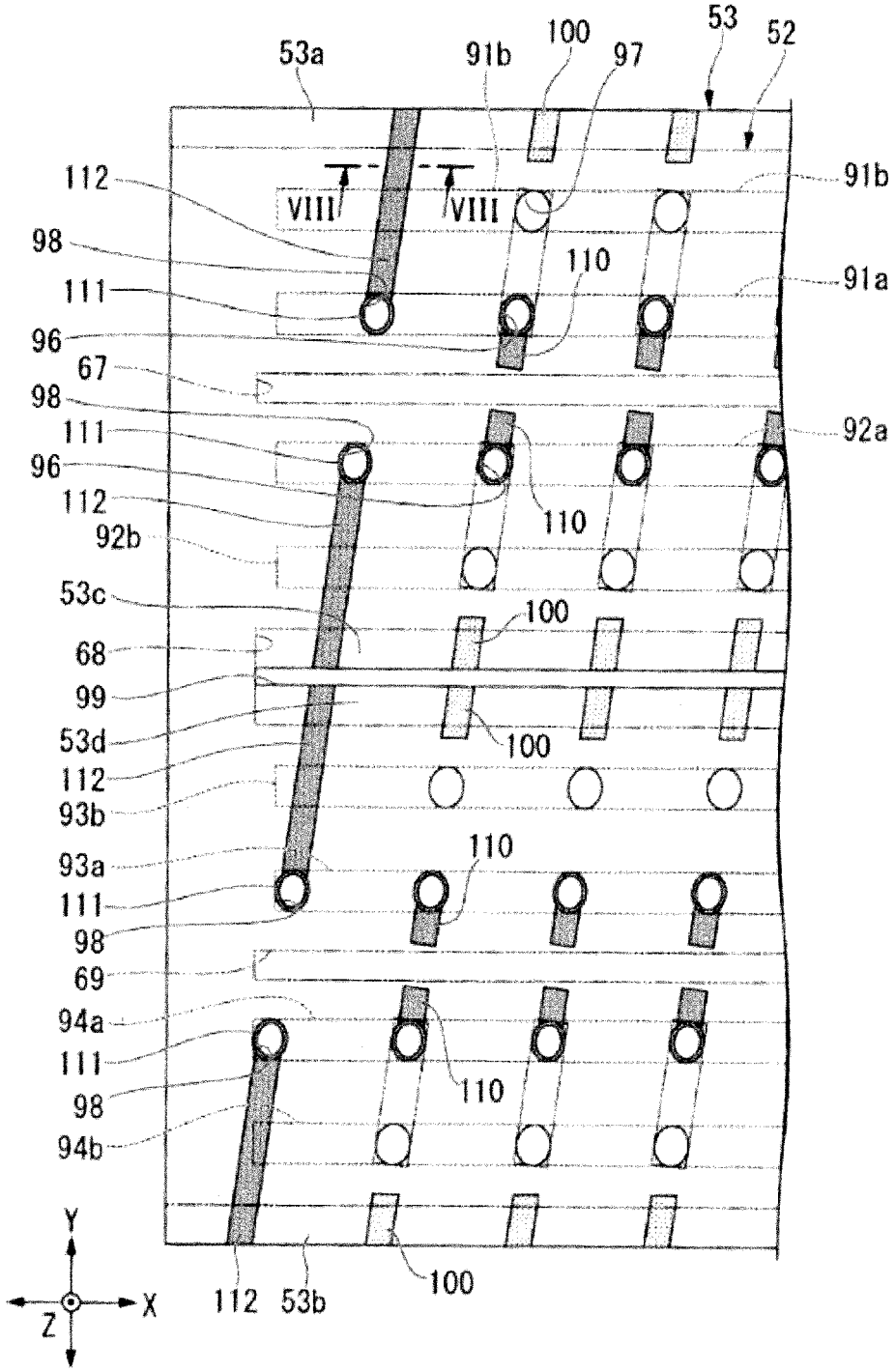
FIG. 7 is a bottom view of a cover plate according to an embodiment.

FIG. 7 is a bottom view of the cover plate 53.

Here, as illustrated in FIGS. 5 and 7, individual pad portions 100 are respectively formed on portions overlapping with the individual wires 78 in plan view, on the back surface of the cover plate 53. The individual pad portion 100 is formed into a strip shape extending in the channel extending direction on the back surface of the cover plate 53. For example, the other end portions in the channel extending direction are electrically connected to the individual wires 78 in the individual pad portions 100 corresponding to the first channel array 63. One end portions in the channel extending direction are pulled out up to the one protruding end portion 53*a* in the cover plate 53, in the individual pad portions 100 corresponding to the first channel array 63.

One end portions in the channel extending direction are electrically connected to the corresponding individual wires 78, in the individual pad portions 100 corresponding to the second channel array 64. The other end portions in the channel extending direction are pulled out up to one exposed end portion 53*c* in the cover plate 53, in the individual pad portions 100 corresponding to the second channel array 64.

The other end portions in the channel extending direction are electrically connected to the individual wires 78, in the individual pad portions 100 corresponding to the third channel array 65. One end portions in the channel extending direction are pulled out up to the other exposed end portion 53*d* in the cover plate 53, in the individual pad portions 100 corresponding to the third channel array 65.

One end portions in the channel extending direction are electrically connected to the individual wires 78, in the individual pad portions 100 corresponding to the fourth channel array 66. The other end portions in the channel extending direction are pulled out up to the other protruding end portion 53*b* in the cover plate 53, in the individual pad portions 100 corresponding to the fourth channel array 66.

Common pull-out wires 110 are formed on portions overlapping with the common wires 76 in plan view, on the back surface of the cover plate 53. The common pull-out wire 110 is formed in a strip shape extending in the channel extending direction on the back surface of the cover plate 53. For example, the common pull-out wires 110 corresponding to the first channel array 63 are electrically connected to the corresponding common wires 76. For example, one end portions in the channel extending direction are pulled out up to back-side opening edges of the supply slits 96 of the first inlet common ink chamber 91*a*, in the common pull-out wires 110 corresponding to the first channel array 63.

As illustrated in FIGS. 3 and 7, connection wires 111 are formed on inner surfaces of the inlet common ink chambers 91*a* to 94*a*, the supply slits 96, and the wire slits 98, in the cover plate 53. The connection wires 111 are electrically connected to the corresponding common pull-out wires 110 of the channel arrays 63 to 66, at the back-side opening edges of the supply slits 96. That is, the common wires 76 are collectively electrically connected (made common) by the connection wire 111 for each of the channel arrays 63 to 66.

As illustrated in FIG. 7, common pad portions 112 are formed on portions positioned on both sides in the X direction with respect to the channel arrays 63 to 66, in the back surface of the cover plate 53. The common pad portion 112 is formed into a strip shape extending in the channel extending direction. For example, the other end portions in the channel extending direction are respectively connected to the connection wires 111 at the back-side opening edges of the wire slits 98, in the pair of common pad portions 112 corresponding to the first channel array 63. One end portions in the channel extending direction are pulled out up to the one protruding end portion 53*a* in the cover plate 53, in the pair of common pad portions 112 corresponding to the first channel array 63. Therefore, the common pull-out wires 110 and the common pad portions 112 corresponding to the first channel array 63 are exposed to an outside on the back surface of the one protruding end portion 53*a* in the cover plate 53.

One end portions in the channel extending direction are connected to the connection wires 111 at the back-side opening edges of the wire slits 98, in the pair of common pad portions 112 corresponding to the second channel array 64. The other end portions in the channel extending direction are pulled out up to the one exposed end portion 53*c*, in the pair of common pad portions 112 corresponding to the second channel array 64. Therefore, the common pull-out wires 110 and the common pad portions 112 corresponding to the second channel array 64 are exposed to an outside through the second dividing portion 68 and the through hole 80, on the back surface of the one exposed end portion 53*c*.

The other end portions in the channel extending direction are connected to the connection wires 111 at the back-side opening edges of the wire slits 98, in the pair of common pad portions 112 corresponding to the third channel array 65. One end portions in the channel extending direction are pull out up to the other exposed end portion 53*d*, in the pair of common pad portions 112 corresponding to the third channel array 65. Therefore, the common pull-out wires 110 and the common pad portions 112 corresponding to the third channel array 65 are exposed to an outside through the second dividing portion 68 and the through hole 80, on the back surface of the other exposed end portion 53*d*.

One end portions in the channel extending direction are connected to the connection wires 111 at the back-side opening edges of the wire slits 98, in the pair of common pad portions 112 corresponding to the fourth channel array 66. The other end portions in the channel extending direction are pulled out up to the other protruding end portion 53*b*, in the pair of common pad portions 112 corresponding to the fourth channel array 66. Therefore, the common pull-out wires 110 and the common pad portions 112 corresponding to the fourth channel array 66 are exposed to an outside, on the back surface of the other protruding end portion 53*b*.

Note that the actuator plate 52 and the cover plate 53 may adhere entirely with a non-conductive adhesive (NCP). In this case, at the time of adhesion, the common wires 76, the common pull-out wires 110, the individual wires 78, and the individual pad portions 100 penetrate the non-conductive adhesive. Accordingly, conduction between the common wires 76 and the common pull-out wires 110 and conduction between the individual wires 78 and the individual pad portions 100 can be achieved. Further, the common wires 76 and the common pull-out wires 110, and the individual wires 78 and the individual pad portions 100, of the actuator plate 52 and the cover plate 53, may adhere with the anisotropic conducting adhesive (ACP), and other areas may adhere with the non-conductive adhesive.

Flexible boards (a first flexible board 120, a second flexible board 121, a third flexible board 122, and a fourth flexible board 123) are mounted on the cover plate 53, corresponding to the channel arrays 63 to 66.

The first flexible board 120 passes through one side in the Y direction with respect to the cover plate 53 and is drawn up to the back side of the cover plate 53 through. The first flexible board 120 is crimped to the back surface of the one protruding end portion 53*a* in the cover plate 53. The first flexible board 120 is electrically connected to the individual pad portions 100 and the common pad portions 112 corresponding to the first channel array 63, on the back surface of the one protruding end portion 53*a*.

The second flexible board 121 is drawn up to the back side of the cover plate 53 through the inserting hole 99 of the cover plate 53. The second flexible board 121 is crimped to the back surface of the one exposed end portion 53*c* in the cover plate 53. The second flexible board 121 is electrically connected to the individual pad portions 100 and the common pad portions 112 corresponding to the second channel array 64, on the back surface of the one exposed end portion 53*c*.

The third flexible board 122 is drawn up to the back side of the cover plate 53 through the inserting hole 99 of the cover plate 53. The third flexible board 122 is crimped to the back surface of the other exposed end portion 53*d* in the cover plate 53. The third flexible board 122 is electrically connected to the individual pad portions 100 and the common pad portions 112 corresponding to the third channel array 65, on the back surface of the other exposed end portion 53*d*.

The fourth flexible board 123 passes through the other side in the Y direction with respect to the cover plate 53 and is drawn up to the back side of the cover plate 53. The fourth flexible board 123 is crimped to the back surface of the other protruding end portion 53*b* in the cover plate 53. The fourth flexible board 123 is electrically connected to the individual pad portions 100 and the common pad portions 112 corresponding to the fourth channel array 66, on the back surface of the other protruding

[Printer Operation Method]

Next, a case of recording letters and figures on the recording medium P, using the printer 1 configured as described above, will be described below.

Note that, as an initial state, the four ink tanks 4 illustrated in FIG. 1 are sufficiently filled with different colors of inks, respectively. Further, the inks in the ink tanks 4 are filled in the ink jet heads 5 through the ink circulation means 6.

Under such an initial state, when the printer 1 is operated, the grid rollers 11 and 13 of the conveyance means 2 and 3 are rotated, so that the recording medium P is conveyed toward the conveying direction (X direction) between the grid rollers 11 and 13 and the pinch rollers 12 and 14. Further, at the same time, the drive motor 38 rotates the pulleys 35 and 36 to move the endless belt 37. Accordingly, the carriage 33 is moved in the Y direction in a reciprocative manner while being guided by the guide rails 31 and 32.

Then, during the movement, the four colors of inks are appropriately injected to the recording medium P by the ink jet heads 5, so that the letters and figures can be recorded.

Here, movement of the ink jet head 5 will be described in detail below.

In the circulation side shoot-type ink jet head 5 like the present embodiment, first, the pressure pump 24 and the suction pump 25 illustrated in FIG. 2 are operated, so that the ink is circulated into the circulation flow channel 23. In this case, the ink circulated in the ink supply pipe 21 passes through the inlet common ink chambers 91*a* to 94*a*, and is supplied into the injection channels 61 of the channel arrays 63 to 66 through the supply slits 96. Further, the inks in the injection channels 61 flow into the outlet common ink chambers 91*b* to 94*b* through the discharge slits 97, and are then discharged to the ink discharge pipe 22. The ink discharged to the ink discharge pipe 22 is returned to the ink tank 4, and is supplied to the ink supply pipe 21 again. Accordingly, the ink is circulated between the ink jet head 5 and the ink tank 4.

Then, when the reciprocative movement is started by the carriage 33 (see FIG. 1), control means applies a drive voltage to the common electrodes 75 and the individual electrodes 77 through the flexible board 120 to 123 and the various wires (the wires 76, 78, 110, and 111 and the pad portions 100 and 112). At this time, the individual electrodes 77 have a drive potential Vdd and the common electrodes 75 have a reference potential GND. Then, thickness slip deformation is caused in the two drive walls 70 that define the injection channel 61, and the two drive walls 70 are deformed to protrude toward the non-injection channel 62 side. To be specific, the drive wall 70 is bent and deformed in a V shape manner around an intermediate portion in the Z direction in the drive wall 70. Accordingly, the injection channel 61 is deformed as if it expands.

As described above, the capacity of the injection channel 61 is increased by the deformation of the two drive walls 70 due to piezoelectric thickness slip effect. Then, as the increase in the capacities of the injection channels 61, the inks stored in the inlet common ink chambers 91*a* to 94*a* are guided to the injection channels 61. Then, the inks guided to the injection channels 61 are propagated to insides of the injection channels 61 by pressure waves, and when the pressure waves reach the nozzle holes 86 to 89, the drive voltage is made zero. Accordingly, the drive walls 70 are restored, and the once increased capacities of the injection channels 61 are returned to the original capacities. With this operation, the pressure inside the injection channels 61 is increased, and the inks are pressurized. As a result, droplet inks are injected to an outside through the nozzle holes 86 to 89, so that the letters and figures can be recorded on the recording medium P as described above.

Here, in the present embodiment, the common wire 76 and the individual wire 78 individually connected to the common electrode 75 and the individual electrode 77 are formed on the surfaces of the bank portions 72A and 72B positioned outside the slits 96 and 97 in the Y direction.

According to this configuration, in pulling out the common wires 76 and the individual wires 78 to an outside in the Y direction with respect to the channel arrays 63 to 66, it is not necessary to pull out the common wires 76 and the individual wires 78, avoiding the slits 96 and 97, like a conventional case. Accordingly, occurrence of a restriction in a forming space of the wires on the surfaces of bank portions 72A and 72B can be suppressed. Therefore, facilitation of wire formation, such as securing of the pitch between the common wire 76 and the individual wire 78, can be achieved.

Then, in the present embodiment, the flexible boards 120 to 123 are respectively mounted to the end portions 53*a* to 53*d* of the cover plate 53 on the back surfaces thereof, the end portions protruding from the actuator plate 52.

According to this configuration, entry of the anisotropic conducting adhesive into the channels 61 and 62 through the opening portions of the channels 61 and 62 in the back surface of the actuator plate 52 can be suppressed at the time of mounting, unlike the configuration to mount the flexible boards on the back surface of the actuator plate 52. Accordingly, occurrence of cracks and the like in the actuator plate 52 due to thermal contraction of the anisotropic conducting adhesive can be suppressed, and improvement of the yield can be achieved.

Further, the flexible boards 120 to 123 do not protrude to the back side beyond the nozzle plate 51, in the back surface of the actuator plate 52. Therefore, variation in the nozzle surface height of the ink jet head 5 can be suppressed. Therefore, the assemblability in assembling the ink jet head 5 to the carriage 33 can be improved, and the distance between the recording medium P and the nozzle plate 51 can be kept constant.

Note that, in the illustrated example, the thicknesses in the Z direction of the actuator plate 52 and the cover plate 53 are illustrated in an equal manner to make the actuator plate 52 recognizable. However, the thickness in the Z direction of the cover plate 53 is favorably thicker than the thickness of the actuator plate 52. With such a configuration, the strength of the end portions 53*a* to 53*d* can be secured and occurrence of the cracks and the like can be suppressed, compared with a case in which the protruding end portions protruding with respect to the cover plate 53 are formed in the actuator plate 52. Further, handling at the time of crimp becomes easier than a case in which the flexible boards are crimped to the protruding end portions of the actuator plate 52.

Further, by pulling out the common electrodes 75 and the individual electrodes 77 to the back surfaces of the end portions 53*a* to 53*d* in the cover plate 53 through the various wires, the common electrodes 75 and the individual electrodes 77 can be connected to the flexible boards 120 to 123 on the same surface. Accordingly, connection work between the cover plate 53 and the flexible boards 120 to 123 can be simply performed.

In the present embodiment, the common wires 76 and the individual wires 78 are individually formed on the surfaces of the different bank portions 72A and 72B, and thus the areas of the forming areas of the wires 76 and 78 can be secured, compared with a case in which the common wires 76 and the individual wires 78 are formed on the same bank portions 72A and 72B. As a result, electric resistance in the wires 76 and 78 can be decreased, and heat generation in the wires 76 and 78 can be suppressed. Further, short circuit between the wires 76 and 78 can be suppressed. Further, the contact areas between the flexible boards 120 to 123 and the pad portions 100 and 112 are increased, and thus connection failure can be reduced.

Then, the printer 1 of the present embodiment includes the above-described ink jet head 5, and thus the reliable printer 1 can be provided.

Note that the technical scope of the present invention is not limited to the above-described embodiment, and various changes can be added without departing from the gist of the present invention.

For example, in the above-described embodiment, the ink jet printer 1 has been described as an example of a liquid jet device. However, an embodiment is not limited to the printer. For example, the present invention can be applied to a facsimile device, an on-demand printer, and the like.

In the above-described embodiment, the ink jet head 5 including four arrays of the nozzle holes 86 to 89 has been exemplarily described. However, an embodiment is not limited thereto. That is, the present invention can be applied to an ink jet head including one array of nozzle holes or an ink jet head including a plurality of arrays of nozzle holes, other than four arrays.

In the above-described embodiment, the side shoot-type ink jet head 5 has been described. However, an embodiment is not limited thereto. For example, the present invention can be applied to so-called an edge shoot-type ink jet head that injects an ink from an end portion in a channel extending direction in an injection channel.

In the above-described embodiment, the configuration using the chevron board has been described as the actuator plate 52. However, an embodiment is not limited thereto. That is, a monopole substrate in which a polarization direction is set to one direction along the thickness direction can be used as the actuator plate.

Figure 8:
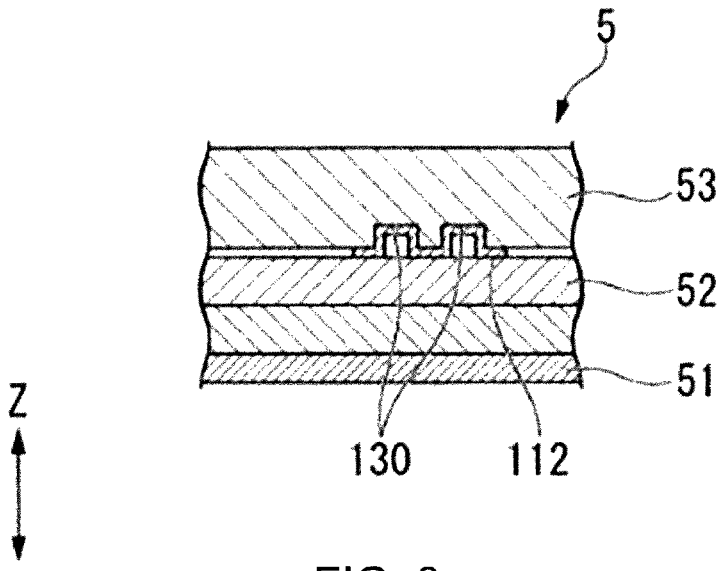
FIG. 8 is a sectional view corresponding to a VIII-VIII line of FIG. 7, according to another configuration of an embodiment.

Further, as illustrated in FIG. 8, a recess portion 130 depressed toward the front side may be formed in the forming area of the common pad portion 112, of the back surface of the cover plate 53. The recess portion 130 extends in a groove manner along the extending direction of the common pad portion 112. A plurality of the recess portions 130 is formed at intervals in the X direction. Then, the common pad portion 112 is formed on an inner surface of the recess portion 130 and portions positioned on both sides in the X direction with respect to the recess portion 130, on the back surface of the cover plate 53, in section view as viewed from the Y direction.

According to this configuration, the area of the common pad portion 112 can be secured, compared with a case in which the forming area of the common pad portion 112, of the back surface of the cover plate 53, is formed on a flat surface. Accordingly, electric resistance of the common pad portion 112 can be decreased, and heat generation in the common pad portion 112 can be suppressed. Note that the shape of the recess portion 130 does not necessarily extend in the extending direction of the common pad portion 112, and appropriate change can be made. Further, a projection portion may be formed, in place of the recess portion 130. Further, in the example of FIG. 8, the case in which the recess portion 130 is formed in the forming area of the common pad portion 112 has been described. However, an embodiment is not limited thereto, and an uneven portion may be formed in the forming area of the individual pad portion 100.

In the above-described embodiment, the case in which the various wires corresponding to the first channel array 63 and the second channel array 64 and the various wires corresponding to the third channel array 65 and the fourth channel array 66 are formed in a point symmetrical manner has been described. However, an embodiment is not limited thereto. The layout of the various wires can be appropriately changed. In this case, in the above-described embodiment, the case in which the connection wires 111 are formed on the side of the inlet common ink chambers 91*a* to 94*a* has been described. However, the connection wires may be formed on the side of the outlet common ink chambers 91*b* to 94*b*.

In the above-described embodiment, the configuration to connect both of the individual pad portions 100 and the common pad portions 112 to the flexible boards 120 to 123 on the back surface of the cover plate 53 has been described. However, at least the individual pad portions 100 may be connected to the flexible boards in portions of the cover plate 53 other than the back surface (for example, both end surfaces in the Y direction or the like). In this case, especially, an electrode that requires individual application of a voltage and individual connection to the flexible boards 120 to 123, like the individual electrode 77, is connected to the individual wire 78 outside the slits 96 and 97, so that the facilitation of the wire formation becomes more remarkable.

In addition, the configuration elements in the embodiment can be appropriately replaced with known configuration elements without departing from the gist of the present invention, and the above-described modifications can be appropriately combined.

What is claimed is:

1. A liquid jet head comprising:

an actuator plate on which jet channels and non-jet channels extend along a first direction and are alternately arranged side by side at intervals in a second direction intersecting with the first direction;

a cover plate laminated on a surface of the actuator plate, and including a liquid supply path communicating into a jet channel;

a drive electrode formed on inner surfaces of the jet channel and a non-jet channel; and a drive wire formed on the surface of the actuator plate outside the liquid supply path in the first direction, and connected to the drive electrode, wherein the cover plate includes:

a protruding end portion protruding outward in the first direction with respect to the actuator plate, and a pad portion connected to the drive wire and connected to an external wire in the protruding end portion, the pad portion being formed on a portion of a back surface of the cover plate outside the liquid supply path in the first direction.

2. The liquid jet head according to claim 1, wherein the drive electrode includes:

a common electrode formed on the inner surface of the jet channel; and an individual electrode formed on the inner surface of the non-jet channel, the drive wire includes:

a common wire connected to the common electrode; and an individual wire bridging the individual electrodes facing each other in the second direction across the jet channel, a connection wire that collectively connects a plurality of the common wires is formed on the cover plate, and the pad portion includes:

a common pad portion connected to the common wire through the connection wire; and an individual pad portion connected to each of the corresponding individual wires.

3. The liquid jet head according to claim 2, wherein one of the common wire and the individual wire is formed on one side in the first direction of the jet channel, on the surface of the actuator plate, and the other of the common wire and the individual wire is formed on the other side in the first direction of the jet channel, on the surface of the actuator plate.

4. The liquid jet head according to claim 3, wherein an uneven portion is formed in a forming area of the pad portion, of the back surface of the cover plate.

5. The liquid jet head according to claim 2, wherein an uneven portion is formed in a forming area of the pad portion, of the back surface of the cover plate.

6. The liquid jet head according to claim 1, wherein an uneven portion is formed in a forming area of the pad portion, of the back surface of the cover plate.

7. A liquid jet device comprising:

the liquid jet head according to claim 1; and a moving mechanism configured to relatively move the liquid jet head and a recording medium.

8. A liquid jet head comprising:

an actuator plate on which jet channels and non-jet channels extend along a first direction and are alternately arranged side by side at intervals in a second direction intersecting with the first direction;

a cover plate laminated on a surface of the actuator plate, and including a liquid supply path communicating into a jet channel;

a common electrode formed on an inner surface of the jet channel;

an individual electrode formed on an inner surface of a non-jet channel;

a common wire formed on the surface of the actuator plate outside the liquid supply path in the first direction, and connected to the common electrode; and an individual wire formed on the surface of the actuator plate outside the liquid supply path in the first direction, and bridging the individual electrodes facing each other in the second direction across the jet channel, wherein an individual pad portion connected to the individual wire and connected to an external wire, the individual pad portion being formed on a portion of the cover plate outside the liquid supply path in the first direction.

9. A liquid jet device comprising:

the liquid jet head according to claim 8; and a moving mechanism configured to relatively move the liquid jet head and a recording medium.

* * * * *